US010377055B2

(12) United States Patent
Froese et al.

(10) Patent No.: US 10,377,055 B2
(45) Date of Patent: Aug. 13, 2019

(54) MULTI-TYPE FOOD PROCESSING DEVICE AND METHOD

(71) Applicant: Weber Maschinenbau GmbH Breidenbach, Breidenbach (DE)

(72) Inventors: Olaf Froese, Neubrandenburg (DE); Marco Loewe, Neubrandenburg (DE)

(73) Assignee: WEBER MASCHINENBAU GMBH BREIDENBACH, Breidenbach (DE)

( * ) Notice: Subject to any disclaimer, the term of this patent is extended or adjusted under 35 U.S.C. 154(b) by 4 days.

(21) Appl. No.: 14/700,643

(22) Filed: Apr. 30, 2015

(65) Prior Publication Data

US 2015/0321369 A1 Nov. 12, 2015

(30) Foreign Application Priority Data

May 7, 2014 (DE) ..... 10 2014 006 660

(51) Int. Cl.
*B26D 5/00* (2006.01)
*B26D 7/30* (2006.01)
(Continued)

(52) U.S. Cl.
CPC ..... *B26D 7/30* (2013.01); *B26D 5/26* (2013.01); *B26D 7/0633* (2013.01); *B26D 7/32* (2013.01);
(Continued)

(58) Field of Classification Search
CPC ..... Y10S 83/932; B26D 2210/02; B26D 7/30; B26D 7/32
See application file for complete search history.

(56) References Cited

U.S. PATENT DOCUMENTS 3,708,055 A * 1/1973 Miller ..... B65G 47/681 198/357
3,827,319 A * 8/1974 Flesch ..... B26D 7/30 83/73
(Continued)

FOREIGN PATENT DOCUMENTS

AT 385939 B 6/1988
CA 2376100 A1 * 4/2001 ..... B26D 5/00
(Continued)

OTHER PUBLICATIONS

European Search Report dated Sep. 29, 2015; 5 pages.
German Search Reported dated Mar. 9, 2015; 10 pages.

*Primary Examiner* — Jennifer B Swinney
(74) *Attorney, Agent, or Firm* — Brooks Kushman P.C.

(57) ABSTRACT

The present disclosure relates to a method and device for processing food. The device comprises at least two food slicing devices adapted to each produce partial portions, and a combination device disposed downstream of each food slicing device to combine the partial portions to a multi-type portion. A sensor assembly may be provided to determine at least one property of the partial portions, wherein a control device is provided to control the operation of the food slicing devices based on the properties of the respective partial portions to adjust the weight of the partial portions. A control device is alternatively provided to synchronize the timing of the slicing operation of the food slicing devices. A buffering device is alternatively provided between at least one food slicing device and the combination device to retain and release partial portions based on a control signal from a control device.

14 Claims, 3 Drawing Sheets

(51) Int. Cl.

| | |
|---|---|
| ***B26D 7/06*** | (2006.01) |
| ***B26D 5/26*** | (2006.01) |
| ***B65B 35/36*** | (2006.01) |
| ***B26D 7/32*** | (2006.01) |
| ***B26D 11/00*** | (2006.01) |
| ***B65B 25/06*** | (2006.01) |
| ***B65B 65/00*** | (2006.01) |
| ***B65B 5/06*** | (2006.01) |
| ***B65B 5/10*** | (2006.01) |
| *B65B 25/08* | (2006.01) |

(52) U.S. Cl.

CPC ..... *B26D 11/00* (2013.01); *B65B 5/068* (2013.01); *B65B 5/10* (2013.01); *B65B 5/105* (2013.01); *B65B 25/06* (2013.01); *B65B 35/36* (2013.01); *B65B 65/003* (2013.01); *B26D 5/00* (2013.01); *B26D 2210/02* (2013.01); *B65B 25/08* (2013.01); *B65B 2220/14* (2013.01); *Y10T 83/0448* (2015.04); *Y10T 83/159* (2015.04); *Y10T 83/182* (2015.04); *Y10T 83/2022* (2015.04); *Y10T 83/2192* (2015.04)

(56) References Cited

U.S. PATENT DOCUMENTS

| | | | | | |
|---|---|---|---|---|---|
| 3,905,259 | A * | 9/1975 | Spooner | B26D 7/30 | 177/120 |
| 4,428,263 | A * | 1/1984 | Lindee | B26D 7/018 | 83/354 |
| 4,580,475 | A * | 4/1986 | Antonissen | B26D 5/20 | 83/278 |
| 5,205,367 | A * | 4/1993 | Andre | B29C 31/06 | 177/145 |
| 8,820,202 | B2 * | 9/2014 | Schaub | B26D 7/30 | 83/23 |
| 2003/0233918 | A1 * | 12/2003 | Lindee | A22C 17/0033 | 83/13 |
| 2004/0016331 | A1 * | 1/2004 | Wolcott | B26D 7/32 | 83/23 |
| 2005/0132855 | A1 * | 6/2005 | Weber | B26D 9/00 | 83/155 |
| 2008/0250904 | A1 * | 10/2008 | Seager | B26D 7/30 | 83/14 |
| 2011/0056356 | A1 * | 3/2011 | Koch | B26D 7/0616 | 83/471 |
| 2012/0042757 | A1 | 2/2012 | Weber | | |
| 2012/0042758 | A1 | 2/2012 | Weber | | |

FOREIGN PATENT DOCUMENTS

| | | | | |
|---|---|---|---|---|
| CA | 2767423 | A1 * | 1/2011 | B26D 7/30 |
| DE | 2229867 | A1 | 1/1973 | |
| DE | 102012015871 | A1 * | 2/2013 | A22C 11/008 |
| DE | 102012000545 | A1 | 7/2013 | |
| DE | 102012005598 | A1 | 9/2013 | |
| EP | 1732739 | A1 | 12/2006 | |
| EP | 2420362 | A1 | 2/2012 | |
| EP | 2420365 | A1 | 2/2012 | |
| WO | WO-2004/011209 | A1 | 2/2004 | |

* cited by examiner

MULTI-TYPE FOOD PROCESSING DEVICE AND METHOD

CROSS-REFERENCE TO RELATED APPLICATION

This application claims priority to German Patent Application No. 10 2014 006 660.6 filed on May 7, 2014, which is hereby incorporated by reference in its entirety.

The present disclosure relates to a multi-type food processing device comprising at least two food slicing devices that are each adapted to produce partial portions. The present disclosure further relates to a method for processing foods with which various partial portions are produced and combined to form a multi-type portion, in particular multi-flavor portion.

A generic food processing device is known from US 2004/0016331 A1 in which a slicing and conveying system is disclosed that produces multi-type portions. For this, a first slicing machine and a second slicing machine are provided where sensors are arranged downstream of each slicing machine that each determine the length of the partial portions. Their signals are sent to a controller which then controls via the overlap conveyor motors and deposit belt motors to compensate for different portion lengths. Scales are respectively provided downstream of the individual machines, where portions of which the weight is unacceptable are removed via discharge conveyors.

A series of cold cut slicing machines is known from AT 385 939 B, where a central controller is provided for intermittently switching on a drive of the common conveyor belt and for switching on the sliced food carriage drive and the deposit device and possibly the variable conveying paths of the deposit device.

It is the object of the present disclosure to provide a food processing device and a method for processing food which allow raising the quality of the multi-type portions, in particular with respect to their weight and/or composition and which are at the same time efficient.

According to the disclosure, a food processing device is provided that comprises at least two food slicing devices which are adapted to each produce partial portions, a respective sensor assembly which is adapted to determine at least one property of the partial portions produced by one of the food slicing devices, and a combination device which is disposed downstream of at least each food slicing device and adapted to combine the partial portions to a multi-type portion, where a control device is provided according to the disclosure which is adapted to control the operation of the food slicing device based on the properties of the respective partial portions in order to adjust the weight of the partial portions.

Adaptation of the operation of the individual food slicing devices is therefore achieved by processing information relating to the partial portions, so that a property, in particular the weight, of the partial portions can be adjusted, whereby a multi-type portion with great accuracy can be obtained which reaches the target weight due to the properties of the partial portions being adjusted to each other. In food processing devices known in prior art, however, tolerances in the weight of the partial portions add up so that the weight of multi-type portions can only be controlled relatively inaccurately.

The multi-type portion can hereinafter always be a preliminary multi-type portion which is added a further partial portion or a completed multi-type portion which is further processed, in particular packaged.

The food slicing devices employed in the food processing device according to the disclosure are particularly slicers that slice the food products in the shape of food bars, food sticks or naturally-formed foods. Food bars are, for example, cheese bars, sausage bars or ham bars which are characterized by a substantially uniform external shape. Other food products to be sliced by the food slicing machine are, for example, a ham loaf or a naturally shaped cheese having a non-uniform external shape.

The sensor assembly is advantageously arranged downstream of at least one of the food processing devices. The weight or another property, such as the density and/or the volume, of the already sliced partial portion can therewith be determined. The sensor assembly can alternatively be disposed upstream of at least one of the food slicing devices, where a property of the future partial portion can therewith be determined prior to it being sliced. Combinations of food processing devices are also conceivable where one of the food slicing devices comprises a downstream sensor assembly and one of the food slicing devices an upstream sensor assembly.

At least one upstream or downstream sensor assembly is advantageously a scale, where the property determined by this sensor assembly is the weight of the respective partial portions. In one embodiment, all the aforementioned sensor assemblies can be scales. The scale can be associated, for example, with the deposit conveyor of the food slicing device so that the weight of the partial portions can be determined continuously during the slicing process. The scale can be arranged downstream of the deposit conveyor so that only the weight of the already completed partial portions can respectively be determined. The scale can further alternatively be associated with the feeder of the food slicing device and the weight of the partial portions can be determined by evaluating the residual weight of the food product not yet sliced.

In one embodiment, the sensor assembly can be a scanning device that is disposed upstream of at least one of the food slicing devices. The internal composition of the food bar to be sliced can be determined by the scanning device which allows drawing conclusions regarding the weight of partial portions to be sliced because the scanning device can determine, for example, the density distribution within the food product and its volume, from which in particular the weight of the cut slices can be determined. A control device therefore knows the partial portions to be expected and their properties.

The control devices and the food slicing devices are advantageously adapted such that operation of at least one of the food slicing devices is controlled in that the slice thickness of the produced food slices is adjusted. By increasing the slice thickness of at least one of the food slices of a partial portion or by uniformly increasing the thickness of all slices of a partial portion, the weight of the partial portion can thereby be increased or be reduced due to a respective reduction in slice thickness or slice thicknesses.

A partial portion comprises in particular at least one food slice, where a partial portion in preferred embodiments has at least two food slices.

Alternatively or in addition to varying the slice thickness of the produced food slices of the partial portions, the control device and the food slicing devices can be adapted such that operation of at least one food slicing device is controlled in that the number of food slices of a partial portion is adjusted. The weight of the partial portions can therefore be adjusted by adding or omitting a food slice to/from a partial portion.

According to the disclosure, a food processing device is further provided that comprises at least two food slicing devices which are adapted to each produce partial portions, and a combination device which is disposed downstream of at least each food slicing device and adapted to combine the partial portions to a multi-type portion, where a control device is provided according to the disclosure which is adapted to control the timing of the slicing operation of the respective food slicing devices. Synchronization of the slicing operation is achieved in particular by synchronizing the loading processes, i.e., new food products are loaded simultaneously at several food slicing devices. This can achieve that loading-induced breaks can be reduced and that desired partial portions are combined with one another in the downstream combination device or that a buffering device in the form of a backup section can be omitted, respectively, since the partial portions produced simultaneously or in close temporal relation can each be directly combined and further processed. The buffer capacity of possibly provided buffering devices can at least be reduced by synchronization or the buffer capacity is no longer necessarily required, respectively. Existing buffer capacities can be better utilized thereby increasing the throughput of the device.

The control device is in particular adapted to respectively synchronize the slicing end and/or the slicing start of the slicing operation of the food slicing devices. This means that the slicing operation for partial portions is simultaneously started and/or ended, or at least timed to each other. The loading operations at the food slicing devices can further be synchronized.

According to the disclosure, a food processing device is further provided that comprises at least two food slicing devices which are adapted to each produce partial portions, and a combination device which is disposed downstream of at least each food slicing device and adapted to combine the partial portions to a multi-type portion, where a buffering device is according to the disclosure provided between at least one food slicing device and the combination device which is adapted to retain and release partial portions based on a control signal from a control device.

The buffering device allows, for example, that a partial portion of a food slicing device be retained, while a further partial portion is produced with the other food slicing device and adjusted to the first partial portion, in particular in terms in its weight. Once the further partial portion is produced, the buffering device can release the first partial portion, so that the two partial portions can be combined with one another in the combination device to form a desired multi-type portion. The buffering device in particular comprises a partial portion insertion section, or synchronization section, upstream of the combination device.

In one embodiment, a respective buffering device can be provided downstream of several food slicing devices or downstream of each food slicing device so that respective partial portions can be retained and released to produce desired multi-type portions by combining suitable partial portions.

The control device is advantageous adapted to determine the dwell times of the respective partial portions in the buffering device. This dwell time can in particular reflect the time until a further partial portion adjusted to the first partial portion was produced in a further food slicing device.

In one embodiment, a sensor assembly is further provided in the food processing device according to the disclosure and adapted to determine a property of the partial portions, where the control device is adapted to control the buffering device and the partial portion insertion section on the basis of the properties of the respective partial portions in order to retain partial portions or release them from a partial portion insertion section, so that partial portions—in particular with desired properties—are combined in the combination device. The control device is in particular adapted to control the buffering device based on the weight of the respective partial portions. The control device can advantageously control several buffering devices, each of which is disposed downstream of the individual food slicing devices. Controlling the buffering device can either be effected such that newly produced partial portions are combined with buffered portions or that buffered partial portions are combined with each other.

In one embodiment, the control device is provided in one of the food slicing devices and adapted to control a control device which is arranged in the other food slicing device. This controlling is preferably effected downstream in the direction of conveying or the direction of production, respectively, i.e. the food slicing device that produces the first partial portion controls the food slicing device that produces the second partial portion which is then combined with the first partial portion, where correspondingly more food slicing devices can follow. In other embodiments, however, reverse control can be effected, namely that the food slicing device in the direction of production disposed downstream controls the upstream food slicing device. This is relevant, for example, if loading is to be expected at a food slicing device. Only the partial portions actually required are then produced at an upstream food slicing device.

The food slicing machines are advantageous in communication via a communication device. In particular the control devices in the food slicing machines are in communication via the communication device. Communication can be effected, for example, via a wireless communication device or a wired communication device. It is alternatively also possible that the information regarding the properties of the respective partial portion is stored directly on the partial portions, for example, in a barcode or RFID chip and can be read out by downstream food slicing devices.

In one embodiment, the food slicing devices are in the direction of production downstream of each other. Production of the partial portions in the at least one downstream food slicing device can then be adjusted based upon properties of the partial portions produced in food slicing devices disposed upstream in the direction of production, or their synchronization can be effected or controlling the upstream buffering device can be adapted.

In one embodiment, the food slicing devices can in the direction of production be arranged in parallel. The slicing operation of the respective food slicing devices can in particular then be synchronized to allow concurrent production of partial portions so that buffer capacity can be reduced. The properties of the partial portions produced by the respective food slicing devices can already be determined by the scanning devices disposed upstream of the food slicing devices, such that controlling the production of partial portions or the loading operations can be coordinated.

In one embodiment, a scanning device is disposed upstream of at least one of the food slicing devices, where the scanning device is adapted to determine properties of partial portions prior to their slicing operation, and where the control device is adapted to take into account the properties determined when the slicing operation of the other food slicing device is controlled.

The combination device advantageously is a loader which is adapted to arrange the partial portions with another partial portion on a transport device or on a product carrier, in particular a tray or a package. The partial portion is there in particular at least partially disposed on the other partial portion or vice versa.

In other embodiments, the combination device can be pick and place robots that dispose the partial portions produced by the food slicing devices in a product carrier or a package. The pick and place robot can there in particular select different partial portions being arranged on a buffer in order to combine suitable partial portions to a multi-type portion. Information can be available for this regarding each of the partial portions which has been determined by at least one sensor assembly upstream or downstream of the food slicing devices.

In one embodiment, a transport device is provided upstream of the combination device and in addition to transporting is adapted to rotate the product carrier or package or displace it laterally relative to the direction of transport. It can thereby be achieved that a desired arrangement of the partial portions in a multi-type portion is obtained that serves clearer or more favorable presentation or more efficient or favorable packaging of the multi-type portions.

A method is according to the disclosure further provided for processing foods, where a first partial portion is first produced with a first food slicing device, a property of the first partial portions is determined before or after, furthermore, a second or further partial portion is produced with a second or further food slicing device, where the weight of the second and/or further partial portion is adjusted based on the determined property of the first partial portion, and the first and second or and at least one further partial portion is combined to a multi-type portion.

Multi-type portions having an exact weight can by produced by the method according to the disclosure.

For this, the property determined is in particular the weight of the first partial portion. The density and/or the volume can alternatively be determined.

The weight of the second and/or further partial portion can then be quickly adapted in that the slice thickness of the food slices produced is adjusted. The slice thickness of all the slices of the second and/or the further partial portions can for this be uniformly increased or decreased, or the slice thickness of only one food slice of the second and/or the further partial portion can be increased or decreased.

In one embodiment, the weight of the second and/or the further partial portion is adapted in that the number of food slices of the second and/or the further partial portion is adjusted. This can also occur in combination with varying the slice thickness.

A method for processing food is further provided according to the disclosure comprising the production of first partial portions with a first food slicing device and the synchronous production of second partial portions with a second or further food slicing device in synchronism to the production of the first partial portions, and the respective combination of the first partial portions and the second partial portions to multi-type portions. This means that in particular partial portions are produced at several food slicing devices between synchronous loading breaks. It can thereby be avoided that a food slicing device must be stopped while the other is being loaded. Loading instead occurs synchronously. Here as well, the multi-type portion can in addition to the first and the second partial portion comprise further partial portions. These further partial portions can be combined in particular simultaneously or in close temporal relationship with the first and the second partial portion or be added after the combination of the first and the second partial portion to a preliminary multi-type portion to produce a completed multi-type portion.

The respectively slicing end and/or the slicing start of the slicing operation of the second partial portion is in particular synchronized with the production of the first partial portion or the subsequent partial portion. Loading operations at the individual food slicing devices are likewise synchronized to each other.

A method for processing food is according to the disclosure further provided in which first partial portions are produced with a first food slicing device, and a second partial portion is previously, simultaneously or subsequently produced with a second or further food slicing device, at least the first partial portions are buffered in response to a control signal, one of the buffered first partial portions is selected in response to a control signal and the selected first partial portion and the second partial portion are combined to a multi-type portion. A preliminary or completed multi-type portion with suitable properties, in particular suitable weight, can thereby be produced by the combinations of suitable partial portions. The multi-type portion can in addition to the first and the second partial portion of course comprise further partial portions. The selection of the buffered first partial portions in particular occurs depending on their weight, where it is determined that the weight of the first partial portion is combined with the weight of the second partial portion to result in the desired weight of the multi-type portions.

In one embodiment, the selection is performed by a pick and place robot. The latter is in particular a delta robot that can pick up and relocate partial portions with a gripper. These partial portions are in particular placed onto other partial portions. The first partial portion is in particular deposited on the second partial portion. A gantry robot can alternatively be used, or the selection process can be performed manually, where it is in response to the control signal displayed to the worker in charge which of the buffered first partial portions he should select.

In another embodiment the selection is done by discharging the buffered first partial portion from the buffer to a loader in which the first and the second partial portions are combined. The first partial portion is by the loader in particular at least partially deposited on the second partial portion. The loader is in particular a device with conveyor tracks disposed above each other, in particular conveyor belts, which are guided relative to each another such that the partial portions of the upper conveyor track are in the loader deposited on the partial portion of the lower conveyor track.

In one embodiment, a property of partial portions is respectively determined, where the partial portion is retained or released based on the property of the respective partial portion, so that a combination and thereby an association of partial portions with desired properties occurs. A multi-type portion with desired properties is thereby produced.

In particular the properties of the first partial portions are each determined prior to their slicing operation, where the properties determined are taken into account during the production of the second partial portion or a subsequent partial portion by the second or further food slicing device.

In one embodiment, the first and/or the second partial portions are prior to combination in addition to transport rotated or displaced laterally relative to the direction of transport. Multi-type portions can thereby be produced having a desired arrangement of the individual partial portions.

Combining multi-type portions can occur in various locations, namely on a portioning belt, in a buffer or loader, in the package or with the robot while loading the package. The properties of the partial portions determining the properties of multi-type portions are in particular the weight, the slice thickness, the number of slices, the manner of portioning the partial portions, such as stacked, shingled, or folded, or the portion shape of the partial portion, for example, circle, divided circle, oblong, angular, etc.

The design of the partial portions and/or the multi-type portions can occur on a display device in which the arrangement of the individual slices of the respective partial portions and the arrangement of the partial portions on or beside each other to form a multi-type portion can be determined, where the kind of food product and its production shape are also considered. The number of slices of a partial portion can in addition to its location also be selected. Following the graphic selection of the design of the partial portions and the multi-type portion, the required values for the partial portions are calculated or derived, i.e. in particular the motion of the deposit conveyor of the loader is determined so that the individual slices of the partial portion are suitably arranged. Furthermore, the control of the loader or the pick and place robot, respectively, is calculated or derived for the combination of partial portions to a multi-type portion. The food slicing devices and associated conveyor equipment are coupled via a formatting device which allows for combining the partial portions.

The aforementioned controller is in particular a pilot control, i.e. a higher level controller for all individual machines, namely, in particular, several food slicing devices or other devices such as addition or dispensing devices e.g. for pasty products, cutlery, or the like, tray dispensers, underleaver or sealing and packaging machines. The aforementioned devices are integrated in particular via clocking pulses and operated according to the disclosure in an optimized manner.

Due to the communication between the individual machines, the backup demand, i.e. the buffer demand on the respective (tray) conveyor lines can be reduced, i.e. the backup sections between the individual stations or individual machines can be reduced. These backup sections always arise in particular upstream of a station and serve as buffer zones. Product carriers in the form of trays are e.g. retained on a conveyor system or decelerated and then released again individually or moved onward when the subsequent station, e.g. the loader is free and can load one or several partial portions into it. A pick and place robot can also be used instead of a loader.

The portion throughput is thereby increased even with limited space, and in particular the target weight of the multi-type portion can according to the disclosure be reached more accurately leading to better production yield because the give-away, i.e. the weight portion exceeding the target weight, can be reduced.

The control device in one embodiment controls mainly the actuators associated with the loaders, i.e. acts predominantly at the transfer points between the individual machines when the partial portions are delivered from the portioning belt downstream of the food slicing machines onto a loading belt at the conveyer line. Buffer sections for the partial portions are therefore advantageously also located at the individual machines. Loading or transfer point can be understood as being the end of the food slicing device or food processing device which is located just upstream of the subsequent conveyor device or the packaging machine.

Information is determined in particular regarding the current state of the partial portion production and the multi-type portion production at all loading points and stored in the control device. The estimated production and the expected production process can thereby be determined, where this can lead to deriving the pilot control of the individual components, in particular controlling of the food slicing machines.

Furthermore, pilot control of the buffering devices can be effected in the form of a backup section. In particular the slicing start and the slicing end of at least two food slicing machines are synchronized, so that the length of the buffering device or the backup section can be reduced. The control can focus in particular on the downstream combination devices in the form of loaders, where the control can in particular be an on/off control. This means that there is a respective feed or lag of partial portions in the food slicing machines, i.e. preproduction or postproduction until the buffering device is filled with partial portions up to the respective loading points. Requesting additional partial portions, i.e. partial portions in their exact amount, is therefore done only when a batch is completed. This can occur, for example, when the product, the tray format or the like is changed. Requesting outstanding partial portions when longer loading, setup, maintenance and/or cleaning breaks are expected is also conceivable.

The control device is in particular an overall system control that is effected based on targets which are necessary for the overall result, i.e. the properties of the completed multi-type portions. For this, in particular the food slicing devices, the combination of devices in the form of loaders and the buffering device, in particular in the form of backup sections, are controlled. The control device thereby monitors and controls in particular the conveying device based on the sensor values determined by the sensor assembly for conveying the trays or the backed-up trays that are in particular filled only partially with partial portions of different types and are added further partial portions in order to be completed.

Controlling is preferably done in the direction of production, i.e. the food slicing devices disposed upstream control the food slicing devices disposed downstream.

In particular sensor assemblies can be arranged. In the food processing device according to the disclosure to determine information regarding completed multi-type portions and individual portions which are then processed by the control device. The control device therefore has available in particular information regarding produced, conveyed and expected partial portions. The latter notably by the use of scanning devices upstream of the food slicing device.

In particular weight control in a multi-portion food processing system is enabled. This means that e.g. the over or under weight of partial portions that arose at the various food slicing machines is detected and can be compensated by a subsequent or parallel food slicing device, e.g., in that the latter produces more or less or thicker or thinner slices, respectively. The control device, however, can alternatively in the event of expected incorrect weight of a partial portion in a food slicing device located downstream, which is for example determined by a scanning device, also control the upstream food slicing device accordingly such that more or less or thicker or thinner slices are produced for the respective partial portion, so that a multi-type portion is produced with the target weight when the partial portion with incorrect weight is later combined. Weight compensation is optionally conceivable when a complete partial portion can no longer be produced at a food slicing device for the reason that the food product, in particular the food bar, is already fully sliced. The weight of another partial portion can in compensation for this then be compensated, for example, by increasing the number of slices.

In particular the information being obtained in that a food product is scanned and computationally divided into portions can be used as the basis for controlling. The individual weights of the future partial portions are included in the total portion weight and are thus optimized so that the overall multi-type portion weight is obtained as accurately as possible.

In particular, however, each individual food slicing machine can comprise a downstream check weighing machine for controlling the slicing operation and possibly a downstream device, such as a rocker, for discharging partial portions that greatly deviate from the target weight. Partial portions with less incorrect weight or provisional multi-type portions are added appropriately adapted individual partial portions to form a multi-type portion.

The loading breaks at the individual food slicing machines are recognized by the central control devices and can further be predicted, in particular by scanning the products so that they can be taken into account in the overall production and taken into account in clocking individual food slicing machines by appropriate pilot control. For example, the buffering devices are for this filled such that the multi-type portions are during placement of a new food product added partial portions from the buffer.

The sensor assembly or control device according to the disclosure allows in particular that the dwelling time of the respective partial portions can be calculated by tracking progress of the individual partial portions, i.e., that the dwelling times per section and for every partial portion can be added and displayed. Based on this data, the decision can then be made that they are discharged and therefore are not packaged and used once the dwelling time of the partial portion is too long.

The pilot control via the buffering device in the form of a backup section allows for other expensive components such as sensors to be dispensed with, since the information from the individual machine controls can be used. It is in particular enabled according to the disclosure that trays or portions are provided with desired additional partial portions at the loading points so that desired multi-type portions are obtained.

In particular, a conveyor can be provided which enables rotation or lateral displacement parallel to the track, in particular loading trays or partial portions upstream of a subsequent station. This allows determining the arrangement of the partial portions in a multi-type portion.

Gates can furthermore optionally be provided which can be actuated by the control device and allow partial portions to be discharged or certain sections, such as a buffering device to be bypassed so that increased flexibility in the allocation of partial portions to each other or to product trays or the like is allowed. Furthermore, a buffer section in a side section, where finishing manual work is performed, can be serviced with such gates.

The disclosure shall below be described by exemplary embodiments which are illustrated in the following figures:

BRIEF DESCRIPTION OF THE DRAWINGS

FIG. 1 shows an embodiment of a food processing device according to the disclosure. The food processing device comprises food slicing devices 1, 2, 3 arranged downstream of each other which each have a downstream sensor assembly 4, 5, 6 in the form of a scale. Furthermore, food slicing device 3 has a scanning device 7 arranged upstream, in particular in the form of an X-ray scanner which can determine the internal composition of products passing it, in particular food products, e.g. food bars.

Figure 1:
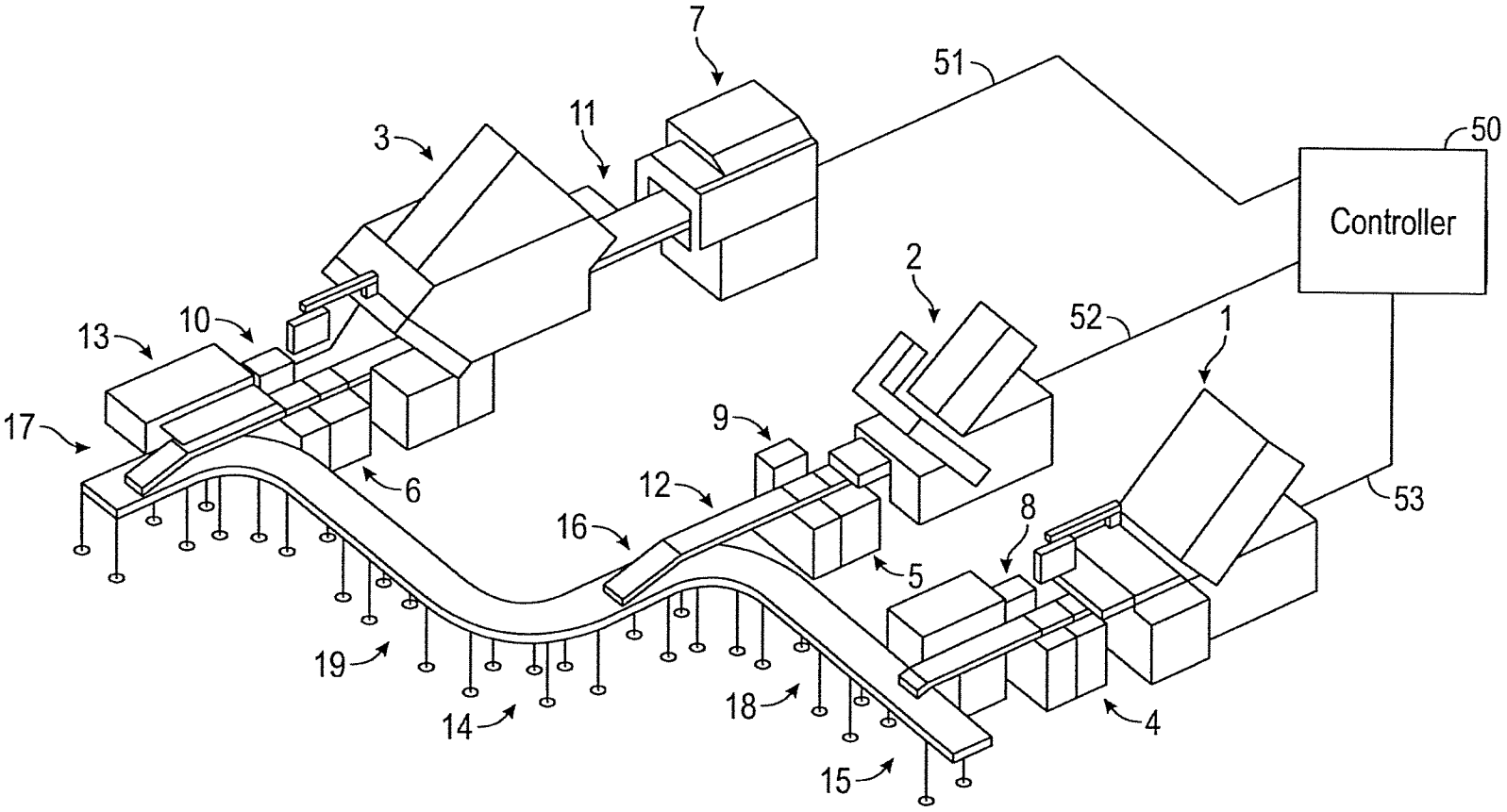
FIG. 1 shows a perspective view of a food processing device according to one embodiment of the present disclosure.

In particular, the different food slicing devices 1, 2, 3 are via a respective feeder 11, which is only illustrated for food slicing device 3, supplied food bars or other food products which are then sliced in food slicing devices 1, 2, 3. Food slicing devices 1, 2, 3 are in particular so-called slicers. Food slicing devices 1, 2, 3 each slice partial portions that are in the overall food processing device farther downstream combined to multi-type portions.

After the slicing operation, the weights of the respective partial portions are first determined by use of scales 4, 5, 6. Alternatively or in addition to scale 6, scanning device 7 is provided as a sensor assembly which also enables determining the weight of the partial portion not yet sliced in that the density and the volume of the portion of the food bar or the food product to be sliced is determined.

Once food slicing device 1 has by use of scale 4 determined the weight of a partial portion that it produced, this information is used in particular for the slicing operation of food slicing device 2 and/or food slicing device 3. If the food portion produced by food slicing device 1 is slightly underweight, the slice thickness of the partial portion produced by food slicing device 2 can in particular be increased or the weight of the food portion produced by food slicing device 3 can be increased, respectively. In particular the weight of the partial portion produced by food slicing device 3 can be adjusted depending on the preceding partial portion produced by food slicing device 1 and the partial portion then produced by food slicing device 2.

The partial portions are via buffering devices 12, 13 supplied to a conveying device 14. Respective loaders 15, 16, 17 are provided for this which allow the partial portions to be arranged on conveying device 14 or on portion carriers, so-called trays, respectively. When at least one partial portion is at loaders 16, 17 already present on conveying device 14 or in the tray arranged thereontop, respectively, loaders 16, 17 represent combination devices that allow the partial portions to be combined to a preliminary or completed multi-type portion. The partial portions are for this arranged on top of each other, namely in particular superimposed on each other, or offset, i.e. partly superimposed, respectively. A buffering device 18 is arranged downstream of loader 15 on conveying device 14 on which the partial portions are buffered until loader 16 is supplied a further partial portion so that a preliminary multi-type portion is formed. A buffering device 19 is arranged downstream of loader 16 in which the partially completed multi-type portions are buffered until loader 17 is at a loading point supplied a further partial portion to complete a multi-type portion. Downstream of loader 17, conveying device 14 leads in particular to a packaging machine 23 in which the multi-type portions are packaged.

In particular a control device 50 is provided which is adapted to control the operation of food slicing device 1, 2, 3 via communication devices (wired or wireless) 51, 52, 53, based on the weight of the respective partial portions in order to adjust the weight of the partial portions. Partial portions which are matched in terms of their weight are therefore combined in loaders 16, 17 and a multi-type portion with high weight accuracy can thus be obtained. Although the control device 50 is shown in FIG. 1 positioned outside of the food slicing devices 1, 2, 3, a control device 50' may be provided in one or more of the food slicing devices 1, 2, 3, as shown for example in FIG. 2.

Furthermore, buffering devices 12, 13, 18, 19 and the associated partial portion insertion sections 8, 9 and 10 can be controlled such that only partial portions are released to loaders 15, 16, 17 that in terms of their weight match each other such that a multi-type portion is obtained having high weight accuracy.

Finally, it is also possible that the operation of the food slicing devices is synchronized such that the entire system can be operated in a clocked manner whereby buffering capacity in buffering devices 12, 13, 18, 19 can be saved.

Figure 2:
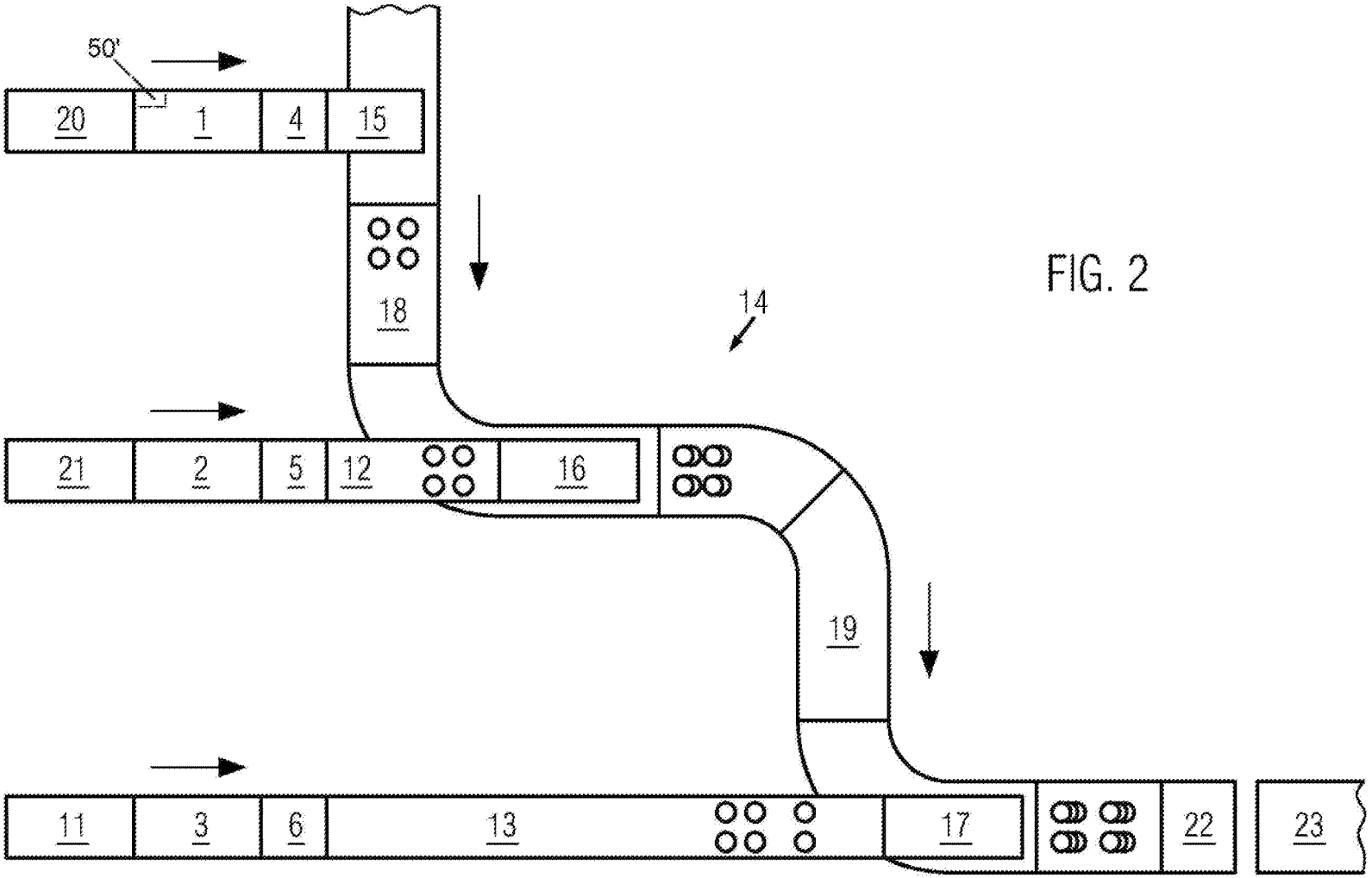
FIG. 2 shows a schematic representation of the arrangement of the components of an embodiment of a food processing device according to the disclosure.

FIG. 2 schematically shows a food processing device that is similar to the one in FIG. 1. FIG. 2 in particular shows further feeders 20, 21 for food slicing devices 1, 2. Upstream of feeders 20, 21 and 11, as shown in FIG. 1 only for feeder 11, scanning devices 7 can be provided so that a respective property of the food sticks or food products, in particular of their future partial portions, can be determined prior to slicing. This information is transmitted to a central control that controls food slicing device 1, 2, 3 accordingly.

Furthermore, no buffering device is in the embodiment of FIG. 2 provided immediately downstream of the first food slicing device 1. In other embodiments, however, a buffering device can be provided so that food portions produced by food slicing device 1 can be buffered. This can be particularly advantageous where food slicing device 1 temporarily produces no partial portions, for example, when food slicing device 1 is newly loaded or is temporarily serviced.

As shown in FIG. 2, a further buffering device 22 can be provided at the end of conveying device 14 which is in particular configured as a conveyor belt, prior to the completed multi-type portions being supplied to packaging machine 23. Before loaders 16, 17, an upstream partial portion insertion section or introduction section, respectively, is provided with which in particular partial portions from buffering devices 12, 13 are held back or released, and in which the partial portions to be combined with each other are arranged above each other on conveyor belts. The partial portions to be combined are oriented as desired on top of each other before the partial portion is deposited by the upper conveying device onto the lower conveying device, which is formed, for example, by conveying device 14, so that it is in the desired manner arranged relative to the other partial portions in a multi-type portion. Here as well, trays or other product carriers can be used. Furthermore, an intermediate sheet of paper or plastic can in the loader be placed between the individual partial portions to separate the partial portions from each other.

Figure 3:
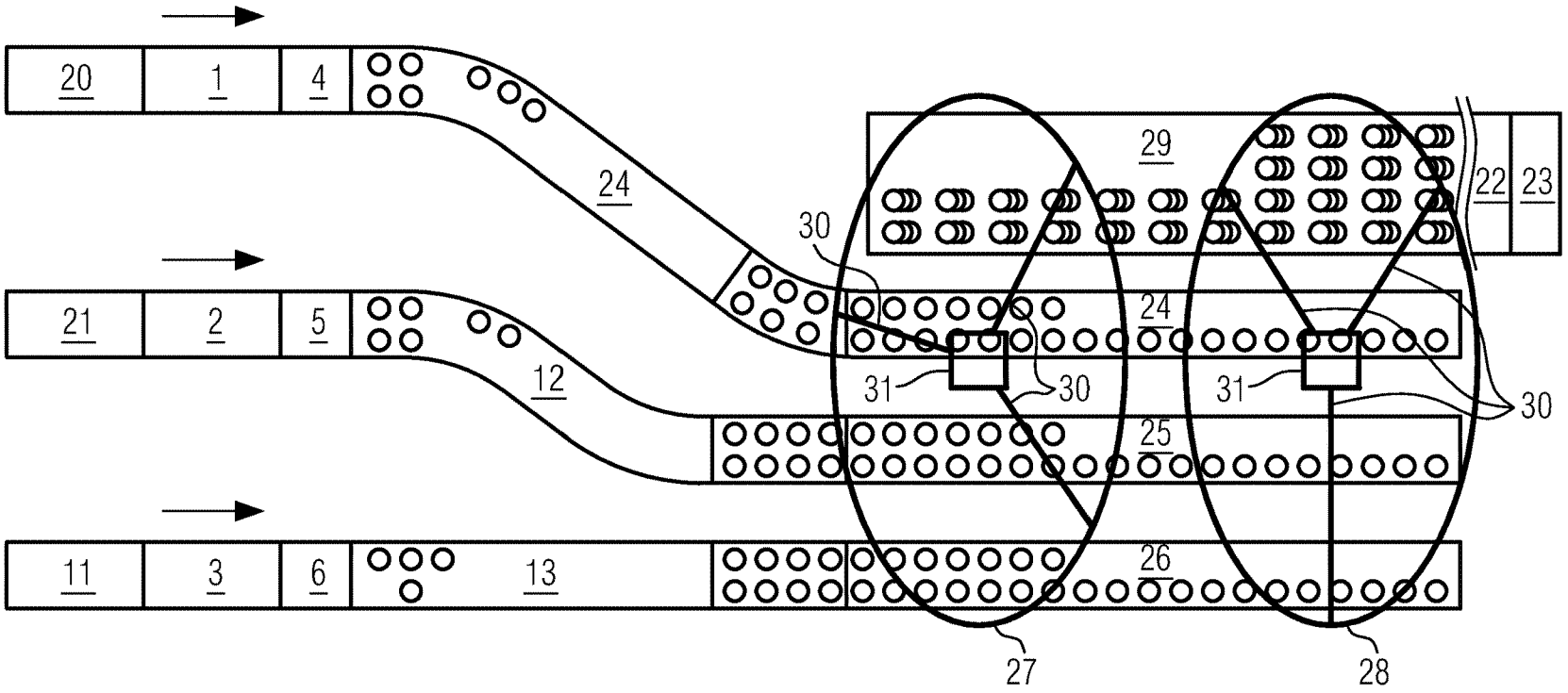
FIG. 3 shows a schematic representation of the arrangement of the components of a further embodiment of a food processing device according to the disclosure.

FIG. 3 shows a further embodiment of a food processing device according to the disclosure. In this embodiment, food slicing devices 1, 2, 3 are arranged in parallel, where they again have upstream feed conveyors 20, 21, 11 and downstream scales 4, 5, 6. The scales are each followed by buffering devices 24, 12, 13, which each lead to a provision section 24, 25, 26. In provision sections 24, 25, 26, several partial portions are respectively held available, where their properties, in particular their weights, are determined by the sensor assemblies in the form of scales 4, 5, 6 or scanning devices 7. At least several pick and place robots 27, 28 are advantageously provided for provision sections 24, 25, 26 which pick up the partial portions and place them in a deposit section 29. Certain partial portions are there respectively selected by the control device and combined such that a multi-type portion having the desired target weight is obtained. In particular the weight is determined for all partial portions of food slicing devices 1, 2, 3 and the position of the partial portions is monitored up to the provision section so that selective picking of the desired portions can then be performed. Provision sections 24, 25, 26 and deposit section 29 are in the present embodiment formed by conveying devices, in particular conveyor belts.

The capacity of buffering device 24, 12, 13 can there again be saved if the production of the partial portions in food slicing devices 1, 2, 3 is synchronized.

Furthermore, provision sections 24, 25, 26 also form buffering devices, where pick and place robots 27, 28 are combination devices which are adapted to grip and to combine the partial portions released by the control device onto provision sections 24, 25, 26.

The pick and place robots are in particular delta robots which each comprise bendable arms 30 and grippers 31.

The completed multi-type portions can be buffered in a buffering device 22 before they are packaged in packaging machine 23.

In particular no scales must be provided downstream of the food slicing devices, where determining the properties of the partial portions can be performed exclusively by the scanning devices respectively arranged upstream of the food slicing devices and can determine the properties of the future partial portions already prior to slicing so that the control of the food slicing devices is effected as a pilot control already upstream of the production of portions or the transfer of portions onto the conveying device.

The invention claimed is:

1. A food processing device comprising:

at least two food slicing devices which are configured to each produce partial portions, a sensor assembly which comprises a scale and is configured to determine at least a weight of said partial portions produced by a first food slicing device of said at least two food slicing devices, a combination device configured to receive said partial portions from said food slicing devices and to combine said partial portions from different food slicing devices of said at least two food slicing devices into a multi-type portion, and a control device configured to control an operation of at least a second food slicing device of said at least two food slicing devices based on said weight of said respective partial portions of said first food slicing device in order to adjust a weight of said partial portions to each other such that a target weight of the multi-type portion can be obtained with greater accuracy.

2. The food processing device according to claim 1, wherein said sensor assembly is disposed downstream of at least one of said food slicing devices and upstream of said combination device with respect to a direction of movement of said partial portions produced by said at least one of said food slicing devices.

3. The food processing device according to claim 1, wherein said sensor assembly comprises a scanning device disposed between a feeder and at least one of said food slicing devices.

4. The food processing device according to claim 1, wherein said control device and said food slicing devices are adapted such that the operation of at least one of said food slicing devices is controlled in that a slice thickness of the partial portions is adjusted.

5. The food processing device according to claim 1, wherein said control device and said food slicing devices are adapted such that the operation of at least one of said food slicing devices is controlled in that a number of food slices of a partial portion is adjusted.

6. The food processing device according to claim 1, wherein said control device is provided in one of said food slicing devices.

7. The food processing device according to claim 1, wherein said food slicing devices are in communication via a communication device.

8. The food processing device according to claim 1, wherein said food slicing devices are arranged to deposit respective partial portions onto different sections of a conveying device.

9. The food processing device according to claim 1, wherein said food slicing devices are arranged to deposit respective partial portions onto different parallel conveying devices.

10. The food processing device according to claim 1, wherein a scanning device is disposed between a feeder and at least one of said food slicing devices which is adapted to determine properties of partial portions prior to their slicing operation, wherein said control device is adapted to take into account said properties determined when said slicing operation of said other food slicing device is controlled.

11. The food processing device according to claim 1, wherein said combination device is a loader which is adapted to arrange said partial portions with another partial portion on a product carrier.

12. The food processing device according to claim 1, wherein said combination device is a pick and place robot which arranges said partial portions produced by said food slicing devices on a deposit section.

13. The food processing device according to claim 1, wherein a transport device is provided to transport and rotate the multi-type portions for placement on a deposit section.

14. A food processing device comprising:

first and second food slicing devices which are each configured to produce partial portions;

a sensor assembly configured to determine a weight of a first partial portion produced by the first food slicing device;

a combination device disposed downstream of the first and second food slicing devices relative to a respective direction of movement of the partial portions produced by each of the first and second food slicing devices and configured to combine the first partial portion from the first food slicing device and a second partial portion from the second food slicing device into a multi-type portion; and a control device configured to control an operation of the second food slicing device based on the weight of the first partial portion from the first food slicing device in order to adjust weight of the second partial portion from the second food slicing device so that a target weight of the multi-type portion can be accurately obtained.

* * * * *